United States Patent [19]

Grossbard

[11] 4,118,950

[45] * Oct. 10, 1978

[54] BRILLIANTIZED STEP CUT STONE WITH FACETED CROWN

[76] Inventor: Henry Grossbard, 552 Beach 132nd St., Belle Harbor, N.Y. 11694

[ * ] Notice: The portion of the term of this patent subsequent to May 3, 1994, has been disclaimed.

[21] Appl. No.: 765,834

[22] Filed: Feb. 4, 1977

Related U.S. Application Data

[63] Continuation-in-part of Ser. No. 690,401, May 27, 1976, Pat. No. 4,020,649.

[51] Int. Cl.[2] ..... A44C 17/00

[52] U.S. Cl. ..... 63/32

[58] Field of Search ..... 63/32; D11/90

[56] References Cited

U.S. PATENT DOCUMENTS

| | | | |
|---|---|---|---|
| 138,314 | 4/1873 | Bruhl | 63/32 |
| 270,018 | 1/1883 | Chevassus-Clément | 63/32 |
| 3,394,692 | 7/1968 | Tirakian | 63/32 X |

FOREIGN PATENT DOCUMENTS

| | | | |
|---|---|---|---|
| 6,270 | 2/1898 | Switzerland | 63/32 |

*Primary Examiner*—F. Barry Shay

*Attorney, Agent, or Firm*—Hane, Roberts, Spiecens & Cohen

[57] ABSTRACT

A brilliantized step cut diamond has a straight edged polygonal shaped girdle with side and corner facets, a crown with a table and a table-and-girdle breaks which are faceted; and a pyramidal base having a point culet, a culet break and a girdle break with ridges extending from the culet to the corner of the girdle. A fan with three pairs of triangular halves is disposed symmetrically about each ridge with a triangular facet in each corner of the base having an edge which is colinear with the edge of a corner facet and an apex at a ridge.

7 Claims, 7 Drawing Figures

BRILLIANTIZED STEP CUT STONE WITH FACETED CROWN

CROSS REFERENCE TO RELATED APPLICATION

This application is a continuation-in-part of my application Ser. No. 690,401, filed May 27, 1976 now U.S. Pat. No. 4,020,649.

There is also copending herewith utility application Ser. No. 754,110 and design applications Ser. Nos. 737,895 and 737,896.

BACKGROUND OF THE INVENTION

The invention pertains to cut stones and more particularly to gem stones such as diamonds.

It is known that the brilliant cut maximizes the fire of a diamond. For this reason such a cut is by far the most popular. However, the cut is the most wasteful of diamond raw material.

On the other hand step cut stones such as square cut diamond and emerald cut diamonds while being more conservative of diamond raw material have none of the fire of brilliant cut diamonds. These facts have been known to the diamond trade for a long time and attempts have been made to devise hybrid cuts to capture the advantages of the square and brilliant cut diamonds.

One such hybrid is shown and described in U.S. Pat. No. 3,796,065 for a stone with an emerald cut crown and a modified brilliant cut base. While such a stone has more brilliance than the conventional square or emerald cut stones it does not approach the brilliance of a brilliant cut stone.

The copending application Ser. No. 690,401 does indeed provide a diamond which is on the one hand more brilliant than the heretofore known conventional or hybrid square or emerald cut diamonds and on the other hand is less wasteful of raw material than conventional brilliant cut diamonds. However, it has created a demand for other brilliantized step cut stones.

SUMMARY OF THE INVENTION

Accordingly, it is an object of the invention to provide a diamond of the class described which has a more brilliant crown.

Briefly, the invention contemplates a brilliantized step cut diamond having a straight edged polygonal shaped girdle, a plurality of side facets and corner facets, a crown, and a base. The crown has at least a girdle break, a table break and a table, the table and the girdle break being cut with triangular shaped facets. The base is pyramidal and has a girdle break, a culet break, a culet and a plurality of ridges. Each of the ridges extend from the culet toward a corner. A fan of from one to three pairs of triangular halves and a triangular facet having its base colinear with an edge of a corner facet of the girdle and an apex at the end of a ridge of the pyramid form the faceting at each corner of the base. A kite shaped facet on each side of the base on the culet break disposed between a pair of adjacent fans, and a shield shaped facet on each side of the base on the girdle break form the faceting for the remainder of the base.

BRIEF DESCRIPTION OF THE DRAWING

Other objects, the features and advantages of the invention will be apparent from the detailed description when read with the accompanying drawing which shows by way of example the presently preferred embodiment of the invention wherein.

DESCRIPTION OF THE PREFERRED EMBODIMENTS

Figure 1:
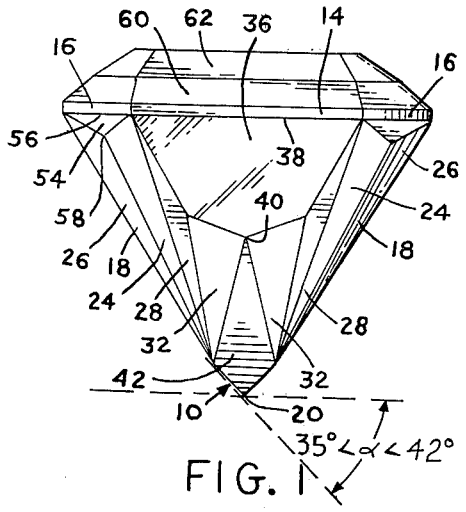
FIG. 1 is a side view of a diamond according to the invention.

The Figures show a step cut diamond 10 having: an octagonal girdle with long side facets 12, short side facets 14 and corner facets 16; a pyramidal base having ridge lines 18, a girdle break, a culet break and a culet 20; and a crown having a girdle break 60, a table break 62 and a table 22.

The base of the stone is so cut that the girdle break has from 20 to 40 percent of the volume of the base with the culet break the remainder. Thus the angle between the plane of the table and the plane of the girdle break is from 40° to 60° . On the long side the angle between the plane of the culet break and the plane of the table is from 35° to 42° . However, since the culet must be in the direct center of the base the angle between the plane of the culet break on the short side and the plane of the table can be as large as 43° if the original stone is square to as low as 30° for oblong stones.

Figure 3:
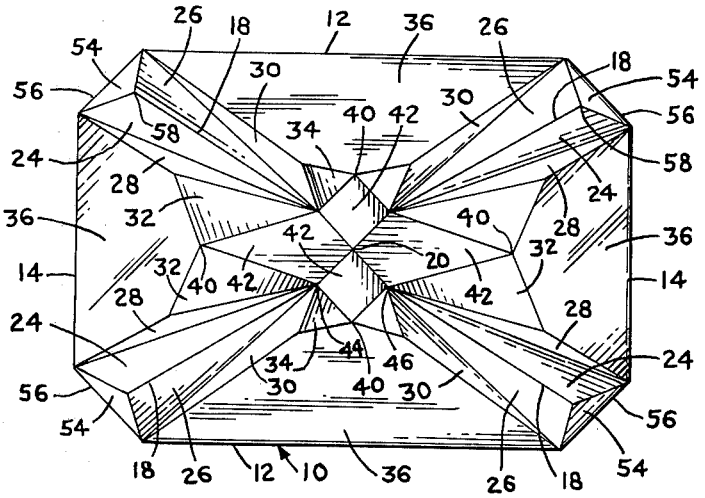
FIG. 3 is a bottom view of the diamond of FIG. 1.

The base is cut with a fan of from one to three pairs of halves cut symmetrically about each ridge line 18. As shown in FIG. 3 three pairs of halves are disposed symmetrically about each ridge line, this being the most preferred number of pairs. More specifically, the first pair comprises halves 24 and 26, the second pair comprises halves 28 and 30 and the third pair comprises halves 32 and 34. After the cutting of the fans, there is left in each side of the base girdle break a shield facet 36 with a base 38 colinear with the girdle, and an apex 40. There is also left in each side of the culet break a kite facet 42. Each kite facet has one point in contact with an apex 40, a diagonally opposite point at the culet 20 and a pair of diagonally opposite points 44 and 46 at the radii of different fans. Finally, it should be noted that when looking directly down into the diamond from the table, the apex 40 of each shield facet 36 is not visible or at most just barely protruding into view.

In order to provide easy mounting of the diamond in a setting the triangular facets 54 are provided in each corner of the base. The baseline 56 of each of these triangular facets is colinear with a side of the adjacent corner facet 16 of the girdle and the apex 58 terminates at a ridge line 18.

The above-described base can be used with many crowns. For example, the base can be used with the crown shown and described in FIG. 4. However, to obtain more brilliance one should cut the crown of FIG. 4. A first desirable cut is shown in FIG. 5. The crown shown in FIG. 5 has pairs of halves (half facets) cut starting at each of the middle corner points 70 of the crown of FIG. 4. Such alternate cutting of the crown as shown in FIG. 5 changes the original sixteen "rectangular" facets of the crown of FIG. 4 into thirty-two triangular facets. Four of these triangular facets are the remains of the table break 62; four are the remains of the girdle break 60; four are the remains of the table break in the corner 16B; four are the remains of the girdle break in the corner 16A; and the remaining sixteen are either of the pairs of halves, such as halves 70A and 70B.

Figure 2:
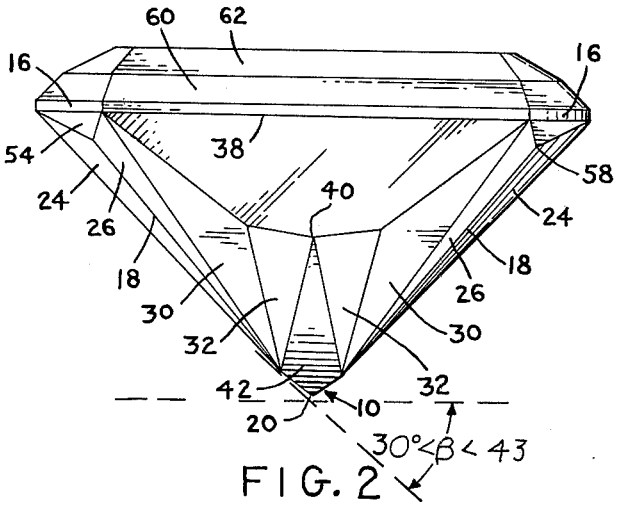
FIG. 2 is the other side view of the diamond of FIG. 1.
Figure 4:
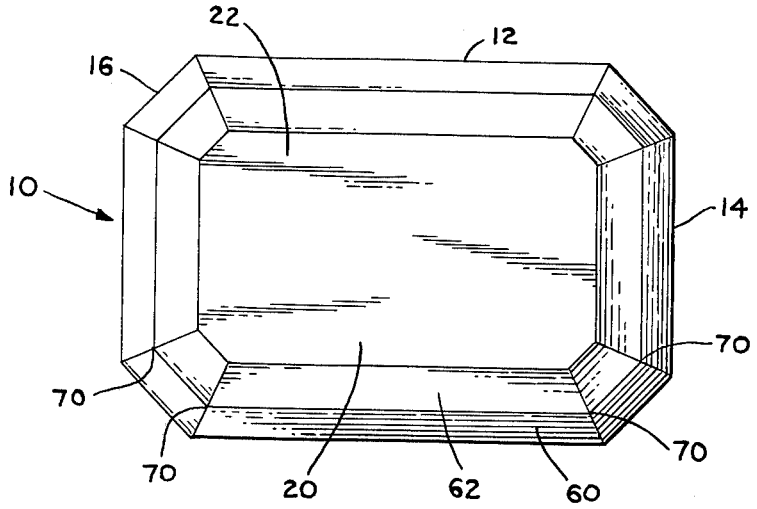
FIGS. 4 to 7 are top views of different embodiments of the diamond of FIG. 1.
Figure 5:
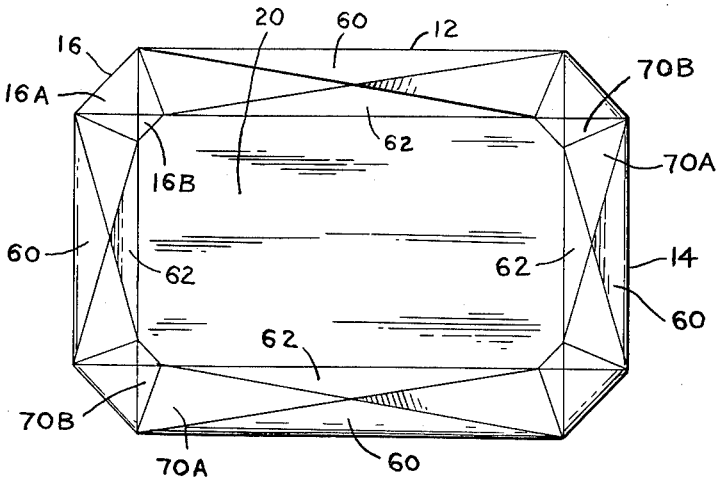
Figure 6:
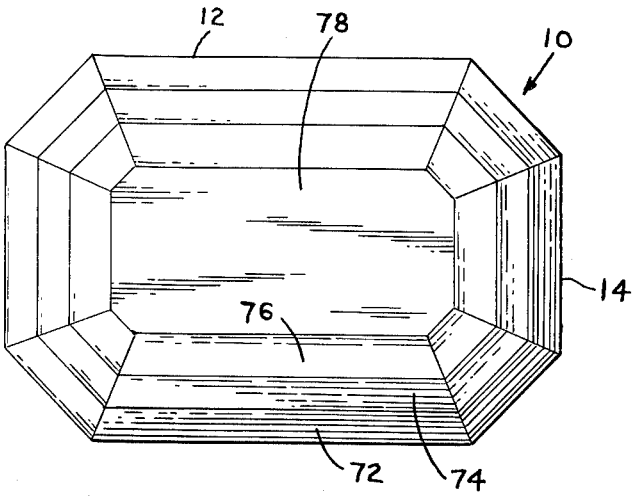

Again starting from the crown of FIG. 4 a new crown can be cut having the three conventional breaks of the emerald cut stone by splitting the table and girdle breaks 62, 60. Thus FIG. 6 shows the crown having girdle break 72, middle break 74, table break 76 and table 78. Although this crown can be used with the base described in FIGS. 1, 2 and 3 the brilliance can be enhanced by further cutting this crown.

Figure 7:
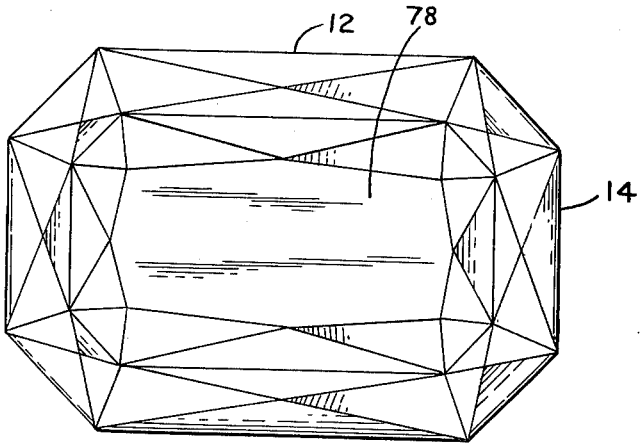

As shown in FIG. 7 the girdle and middle breaks 72, 74 of FIG. 6 are cut with pairs of half facets in the same fashion as the girdle and table breaks 60, 62 of FIG. 4 were cut to form the crown of the diamond of FIG. 5. In addition, the table break 76 of the stone of FIG. 6 is cut with star facets. Therefore the crown of the stone of FIG. 7 has forty-eight triangular facets.

There has thus been shown a step cut diamond, which can range from a square cut to rectangular cut and which has a brilliancy approaching the brilliancy of brilliant cut or round diamonds with nowhere near the loss of raw material.

While only a limited number of embodiments of the invention has been shown and described in detail there will now be obvious to those skilled in the art many modifications and variations satisfying many or all of the objects of the invention but which do not depart from the spirit thereof as defined by the appended claims. For example, although there has been shown only a rectangular cut stone, the invention contemplates any straight edged polygon stone such as regular or irregular hexagonal stones, truncated kite shaped stones, pentagons, etc.

What is claimed is:

1. A brilliantized step cut diamond comprising: a straight edged polygonal shaped girdle with a plurality of side facets and corner facets; a crown, said crown having a girdle break, a table break and a table, said table break and said girdle break being cut with triangular shaped facets; and a pyramidal base, said pyramidal base having a girdle break, a culet break, a point culet and a plurality of ridges, each of said ridges extending from said culet toward a corner, a fan of at least three pairs of triangular halves symmetrically disposed about each ridge of said pyramidal base, a kite shaped facet on each side of the base on the culet break and disposed between a pair of adjacent fans, and a shield shaped facet on each side of the base in the girdle break, each shield shaped facet having a base line parallel to the girdle and an apex in contact with a point of the associated kite shaped facet.

2. The brilliantized step cut diamond of claim 1 further comprising a triangular facet at each corner of the base, each of said latter triangular facets having an edge colinear with the edge of the adjacent corner facet of the girdle and an apex at and ridge.

3. The diamond of claim 2 wherein some of said triangular facets are halves cut into both the table and girdle breaks of the crown.

4. The diamond of claim 2 wherein the crown has a middle break intermediate the table and crown breaks.

5. The diamond of claim 4 wherein some of the triangular shaped facets of said crown are star facets in the table break.

6. The diamond of claim 4 wherein some of the triangular shaped facets of the crown are halves cut into both the girdle and middle breaks of the crown.

7. The diamond of claim 6 wherein other of the triangular shaped facets of the crown are star facets in the table break.

* * * * *